US005441391A

United States Patent [19]

Frost et al.

[11] Patent Number: 5,441,391

[45] Date of Patent: Aug. 15, 1995

[54] AIR PROPELLING APPARATUS WITH FAN SHAFT MOUNTED ON GUARDS

[75] Inventors: Gordon J. Frost; Edward W. Strubel, Jr., both of Fort Wayne, Ind.

[73] Assignee: Patton Electric Company, Inc., New Haven, Ind.

[21] Appl. No.: 177,531

[22] Filed: Jan. 5, 1994

[51] Int. Cl.[6] ..... F04B 17/03

[52] U.S. Cl. ..... 417/362; 417/423.14

[58] Field of Search ..... 417/362, 423.14, 423.12; 416/247 R

[56] References Cited

U.S. PATENT DOCUMENTS

| | | | |
|---|---|---|---|
| 2,115,527 | 4/1938 | Hueglin . | |
| 2,148,524 | 2/1939 | Bartch et al. | 417/423.12 X |
| 2,300,475 | 11/1942 | Ward . | |
| 2,385,152 | 9/1945 | Morrison | 417/362 |
| 2,390,588 | 12/1945 | Heckman . | |
| 2,782,425 | 2/1957 | Schroeter . | |
| 2,875,626 | 3/1959 | Niederer et al. | 417/362 UX |
| 3,190,543 | 6/1965 | Goettl | 417/423.14 X |
| 3,482,767 | 12/1969 | Reinkoester, Jr. . | |
| 3,584,968 | 6/1971 | Keith . | |
| 3,746,464 | 7/1973 | Goettl . | |
| 4,171,937 | 10/1979 | Greenfield . | |
| 4,239,459 | 12/1980 | Felter . | |

*Primary Examiner*—Richard E. Gluck
*Attorney, Agent, or Firm*—George Pappas

[57] ABSTRACT

An air propelling apparatus/fan is provided having an air intake grill and an exhaust grill mounted on the ends of a cylindrical shroud. A shaft is mounted inbetween and on the intake and exhaust grills and a fan blade assembly is provided on the shaft. In one embodiment, the fan blade assembly is adapted for rotational movement about the shaft and a driven pulley is affixed to the fan assembly and is caused to turn via a belt and an electric motor mounted on the shroud. In another embodiment, the fan assembly is affixed to the shaft and the shaft is adapted for rotational movement. The driven pulley is affixed to the shaft and caused to rotate by an electric motor mounted on the shroud.

17 Claims, 3 Drawing Sheets

AIR PROPELLING APPARATUS WITH FAN SHAFT MOUNTED ON GUARDS

TECHNICAL FIELD

The present invention relates to the technical field of air fans or air propelling apparatus. More specifically, the present invention relates to an improved fan having a cylindrical shroud and air intake and exhaust grills at each end thereof.

BACKGROUND OF THE INVENTION

Blower fans are presently commonly used for pushing, propelling, or otherwise circulating air. Normally, the air is circulated for cooling an area or for mixing the air at one temperature with air at another temperature located elsewhere i.e., mixing air near the ground with hot air which has risen near the ceiling.

Many different designs of blower fans have been made and are known to exist. Additionally, various different sizes of blower fans have been made and are known to exist. The larger transportable type of fans are, for example, three to six foot in diameter and are commonly used in large open areas, such as factories, football stadiums, and warehouses. Two of these types of prior art fans are shown in cross section in FIGS. 1 and 2. These typical blower fans, from the exterior, appear similar to that shown in FIG. 3.

The prior art fan shown in FIG. 1 includes an exterior cylindrical shroud 2, an intake disc-shaped grill or guard 4, an exhaust disc-shaped grill or guard 6, and wheels 8 rotatably affixed to shroud 2. In the prior art fan of FIG. 1, a motor 10 is attached to intake grill 4 and fan blades 12 are connected in driving engagement with the shaft of motor 10. The fan blades 12 are, thus, connected to the shaft of motor 10 in a cantilever fashion.

In the prior art fan shown in FIG. 2, unlike that of FIG. 1, an arbor 14 is provided and is attached to shroud 2 for supporting hub member 16. Arbor 14 can be a cross member intersecting at hub 16 wherein the cross members are at 90 degrees or 120 degrees from one another. Alternatively, arbor 14 can be merely vertical bars as, for example, shown in U.S. Pat. No. 4,239,459. Hub member 16, in turn, rotatably supports a shaft 18 having a pulley 20 at one end and the fan blades 12 at the other end. A motor 22 is attached to shroud 2 and drives pulley 24. Pulley 24 is in driving engagement with pulley 20 via belt 26 and, thus, fan blades 12 are also rotatably driven.

The prior art large blower fans, however, have shortcomings and drawbacks. Both prior art designs include a shaft whereupon the fan blades are mounted in a cantilever fashion. As a result, unless the shaft and the bearings thereof are increased in size, the life span is generally decreased. However, increasing the size of the shaft and the bearings increases manufacturing costs. Additionally, with respect to the prior art fan of FIG. 1, increasing the shaft and bearing sizes requires a special motor design thereby further increasing manufacturing costs. With respect to the prior art fan of FIG. 2, manufacturing costs are again increased in view of the additional material and labor required in providing the arbor and hub member combination for supporting the shaft.

Accordingly, a need exists for a blower fan construction that is both long lasting and inexpensive in terms of its material and labor costs.

SUMMARY OF THE INVENTION

It is the principle object of the present invention to overcome the above-discussed disadvantages associated with prior blower fans.

The present invention overcomes the disadvantages associated with prior blower fans by mounting a shaft directly between and on the air intake and exhaust grills. The fan blade assembly is supported on the shaft and is driven by an electric motor, pulleys and belt combination.

In the preferred embodiment, the shaft is rotatably mounted on the intake and exhaust grills and the fan assembly is affixed to the shaft in a manner whereby both the shaft and fan assembly are caused to turn. More specifically, a driven pulley is affixed to the shaft and the electric motor mounted on the shroud is in driving engagement with a driver pulley and a belt around the driver and driven pulleys.

For aiding in the rotational movement of the shaft, bearings are provided at each end thereof between the shaft and the grills. More preferably, bearing retaining plates are attached to each of the grills and the bearings are mounted in bores of each respective retaining plate. Because the bearings and bearing retaining plates are mounted on the grills and the grills are somewhat flexible, the bearings need not be self-aligning. Rather, the grills provide the necessary flexibility for providing the necessary alignment between the bearings and the shaft and for taking into consideration inherent manufacturing inaccuracies. Further yet, so as to prevent the shaft from inadvertently being dislodged at its ends from the grills, the shaft is longer than the cylindrical shroud longitudinal length. In this fashion, the grills are caused to flex longitudinally away from the shroud and continually urge the bearing retaining plates and bearings towards the shaft. The grills thus act similar to springs for placing a longitudinal force on the shaft and placing the shaft in compression.

In another embodiment, the shaft is mounted on the grills but is not adapted for rotational movement. Rather, the fan blade assembly is rotatably mounted on the shaft and the driven pulley is coaxially received around the shaft and affixed to the fan blade assembly. The fan blade assembly and driven pulley are retained in the proper longitudinal position along the shaft by, for example, retaining rings. Bearings are also provided between the fan assembly and the shaft.

In one form thereof, the present invention is directed to an air propelling apparatus including an air intake grill and an air exhaust grill. A shaft extends between and is mounted on the air intake and exhaust grills and a fan blade assembly is provided on the shaft. Means is also provided for turning the fan assembly in a manner whereby air is propelled through the air intake grill and out through the exhaust grill.

BRIEF DESCRIPTION OF THE DRAWINGS

The above-mentioned and other features and objects of this invention and the manner of obtaining them will become more apparent and the invention itself will be better understood by reference to the following description of embodiments of the invention, taken in conjunction with the accompanying drawings wherein.

Corresponding reference characters indicate corresponding parts throughout the several views of the drawings.

Figure 1:
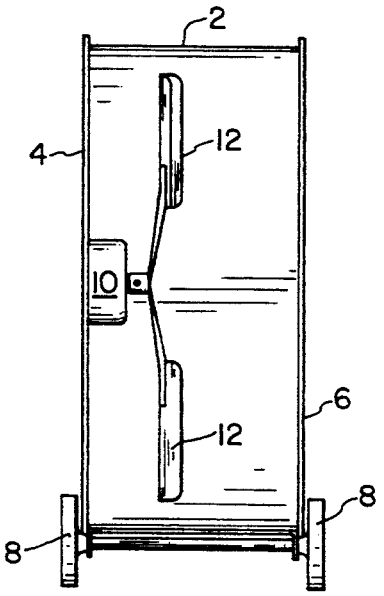
(PRIOR ART) FIG. 1
FIG. 1 is a cross-sectional view of a prior art blower fan structure.
Figure 2:
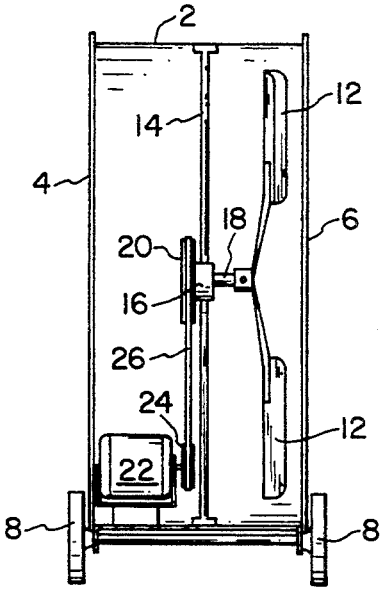
(PRIOR ART) FIG. 2
FIG. 2 is a cross-sectional view of another prior art blower fan structure.

The exemplifications set out herein illustrate preferred embodiments of the invention in one form thereof and such exemplifications are not to be construed as limiting the scope of the disclosure or the scope of the invention in any manner.

DETAILED DESCRIPTION OF SPECIFIC EMBODIMENTS

Referring now to FIGS. 3–7, an air propelling apparatus/fan is shown and includes a cylindrical shroud 30, an air intake grill or guard 32 and an exhaust grill or guard 34. Shroud 30 includes annular lips 36 at each longitudinal end thereof whereupon intake and exhaust grills 32 and 34 are mounted via fasteners such as nuts and bolts 38. Thus, each of intake and exhaust grills 32 and 34 are generally parallel to one another.

Figure 3:
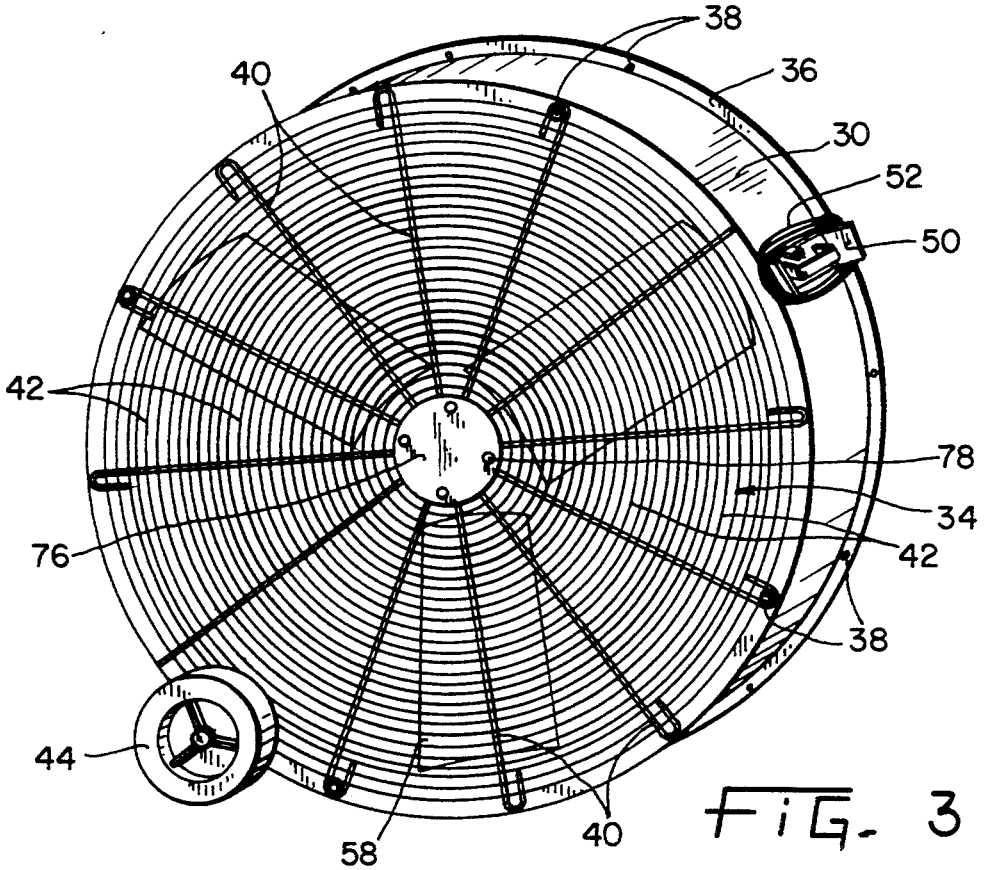
FIG. 3 is a perspective view of a blower fan according to the present invention.

As more clearly shown in FIG. 3, each of the intake and exhaust grills 32 and 34 include radially-extending fingers 40 upon which there are affixed a plurality of rings 42 of differing sizes. Alternatively, a continuous wire member can be wound and fixed on radially extending fingers 40 for creating the appearance of rings 42 in a known and customary manner. It is noted that the assembly of grills 32 and 34 as described and shown provides flexibility thereof at its central area both along the plane of the grills themselves and perpendicularly therefrom (longitudinally through shroud 30).

The overall size of the fan, as shown in the drawings, will normally vary from 3–6 foot in overall diameter. Accordingly, so as to transport the fan, there are provided wheels 44 affixed to the ends of wheel shaft 46 which is, in turn, rotatably supported by U-shaped member 48. U-shaped member 48 is affixed to the outer surface of shroud 30. Handles 50 are also affixed to the outer surface of shroud 30 for grasping by an individual and transporting in conjunction with wheels 44. Handles 50 are also used for safely storing electrical extension 52 when the fan is not in use.

Figure 5:
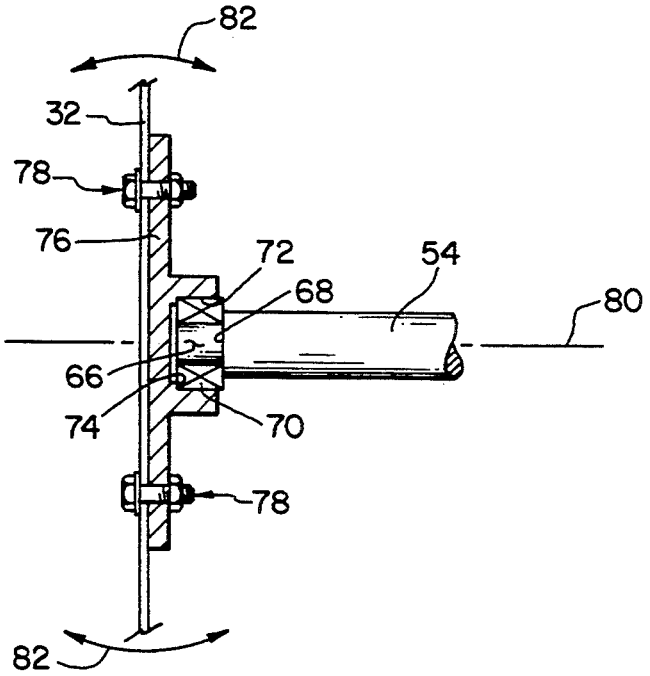
FIG. 5 is a partial cross-sectional view of an end of a shaft and bearing plate according to the present invention and taken along line 5—5 of FIG. 4.
Figure 4:
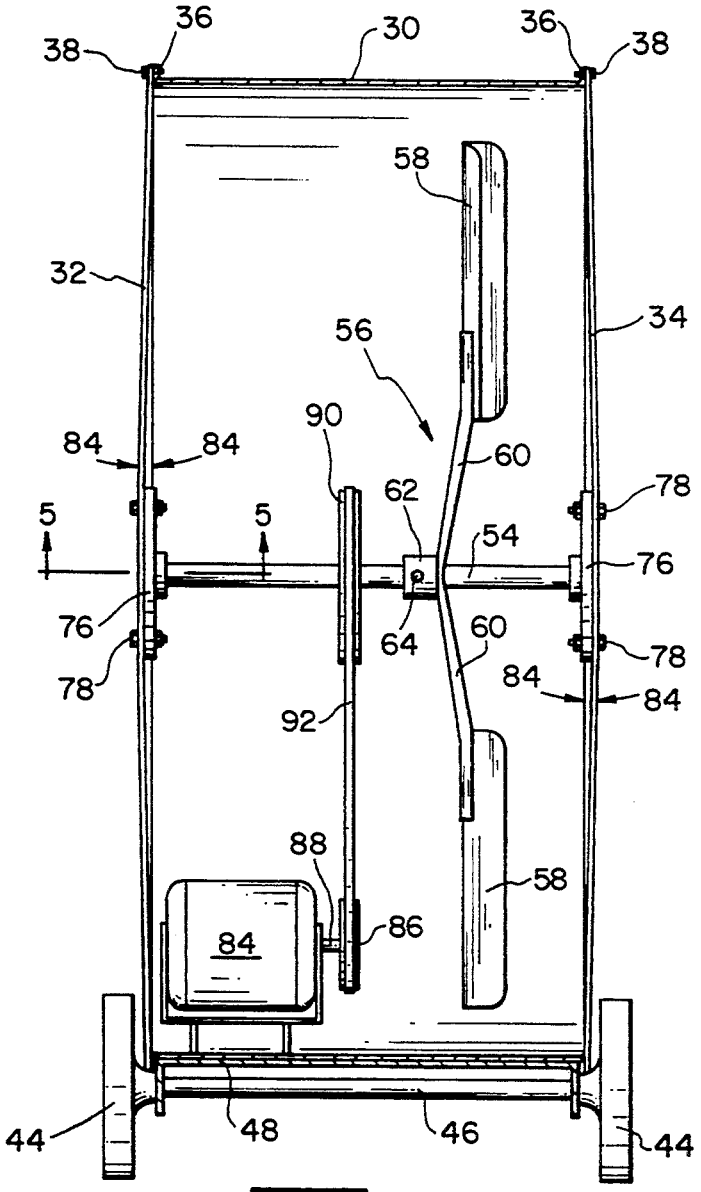
FIG. 4 is a cross-sectional view of the fan shown in FIG. 3 according to the present invention.

Referring now to FIGS. 4 and 5, within shroud 30 and inbetween intake and exhaust grills 32 and 34, there is provided a shaft 54 whereupon there is mounted a fan assembly generally indicated by the numeral 56. Fan assembly 56 includes a plurality of fan blades 58, each affixed to a radial arm 60. Radial arms 60 are affixed to fan ring member 62 coaxially received around shaft 54. Ring member 62 is affixed to shaft 54 by a fastening means. As shown in FIG. 4, a bolt 64 is received in a threaded bore (not shown) of ring member 62 in a manner whereby the tightening of bolt 64 causes frictional engagement between the end of bolt 64 and the inner diameter surface of ring member 62 with the outer surface of shaft 54.

In the embodiment shown in FIGS. 4 and 5, shaft 54 is rotatably mounted on intake and exhaust grills 32 and 34. In this regard, each end of shaft 54 is provided with a bearing retaining surface 66 which can be, as shown, with a smaller diameter than that of shaft 54. Where bearing retaining surface 66 is smaller, a shoulder 68 is also provided whereupon bearing 70 may rest. Bearing 70, in turn, is received within bore 72 incorporating a shoulder 74 and located in bearing retaining plate 76. Each bearing retaining plate 76 is preferably disc-shaped and is affixed to a respective intake or exhaust grill 32 or 34 via a fastening means such as nut and bolt combinations 78. Bearing retaining plates 76 are preferably made of steel, although other suitable materials can be used.

Referring to FIG. 5, it is noted that bearings 70 need not be of the self-alignment type due to the flexibility of grills 32 and 34. More specifically, manufacturing inaccuracies in the components and the overall assembly will generally cause shaft 54 to be somewhat misaligned with the desired longitudinal axis 80. However, depending on this misalignment, grills 32 and 34 will flex as indicated by the arrows 82 pivoting around axis 80 and thereby causing sufficient proper alignment between the end of shaft 54 and bearing 70 within bore 72 of plate 76.

So as to retain shaft 54 in its position as shown in FIG. 4, the shaft is made to be longer than the cylindrical shroud longitudinal length. This causes grills 32 and 34 to flex longitudinally away from the shroud ends by a short distance indicated by arrows 84. As discussed hereinabove, the grills are flexible in part and act similar to springs urging the bearing plates 76 towards shaft 54 and thereby retaining bearings 70 and shaft 54 in continuous longitudinal compression.

Shaft 54 is rotationally driven through the use of an electric motor 84 mounted on shroud 30 in a known and customary manner. A driver pulley 86 is affixed to shaft 88 of motor 84 and is in driving engagement therewith. A driven pulley 90 is provided on shaft 54 and is affixed thereto in a known and customary manner. A belt 92 is received around driver and driven pulleys 86 and 90 and, thus, by turning pulley 90, shaft 54 along with fan assembly 56 are caused to turn for propelling air through intake grill 32 and out through exhaust grill 34.

Figure 6:
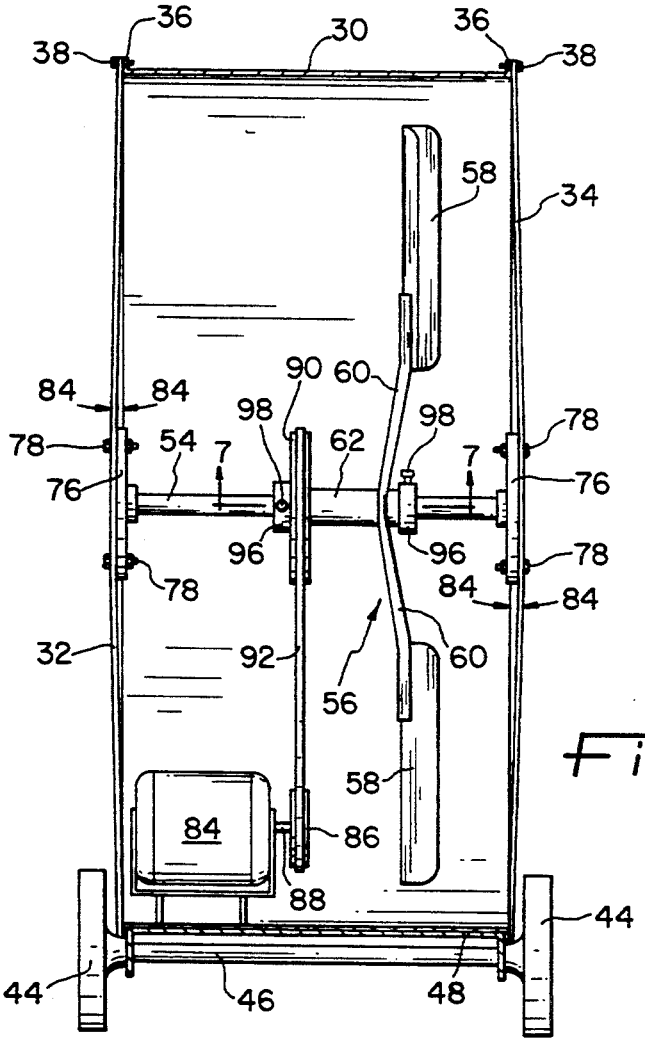
FIG. 6 is a cross-sectional view of the fan shown in FIG. 3 and showing another embodiment according to the present invention; and, FIG. 7 is a partial cross-sectional view of the shaft, pulley and fan assembly combination of the embodiment shown in FIG. 6 and taken along line 7—7.
Figure 7:
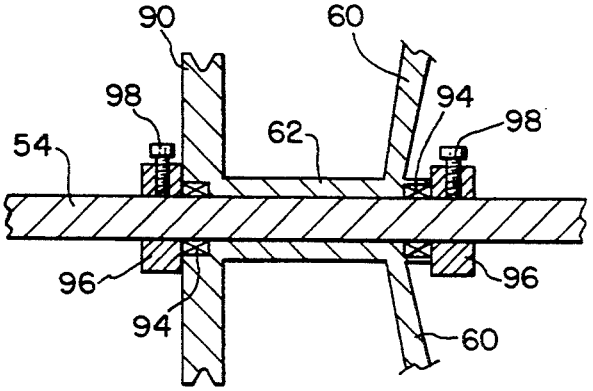

Referring now to FIGS. 6 and 7, there is shown another embodiment according to the present invention wherein shaft 54 is mounted on and inbetween intake and exhaust grills 34 but is not adapted for rotational movement. As shown, shaft 54 is again mounted on bearing plates 76. However, in this embodiment, bearings 70 are not incorporated. Here, the fan ring member 62 upon which radial arms 60 are mounted, is adapted for rotational movement about shaft 54. Driven pulley 90 is affixed to fan ring member 62 by either forming therewith or welding or other suitable means. Bearings 94 are provided inbetween shaft 54 and fan ring member 62 and driven pulley 90 for aiding the rotational movement thereof about shaft 54. Ring member 62 and driven pulley 90 are retained from slipping longitudinally along shaft 54 by retaining rings 96 which are adapted to frictionally engage shaft 54 with bolts 98. It is noted that other suitable longitudinal retaining means such as annular shoulders formed on shaft 54, etc., are also contemplated for potential use in this embodiment and in retaining the longitudinal position of ring member 62 and driven pulley 90.

As can be appreciated, the structure of the air propelling apparatus, according to the present invention, decreases manufacturing costs while generally increasing the life span of the apparatus. A cantilever design along with the entire construction and assembly of an arbor have been eliminated while a generally rugged construction is still provided.

While the invention has been described as having specific embodiments, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An air propelling apparatus comprising:
an air intake grill;
an air exhaust grill;
a shaft extending between and mounted on said air intake and exhaust grills;
a fan blade assembly on said shaft;
means for turning said fan blade assembly whereby air is propelled through said air intake grill and out through said exhaust grill and;
means for placing said shaft in longitudinal compression.

2. The air propelling apparatus of claim 1 wherein said shaft is rotatably mounted on said intake and exhaust grills and said fan assembly is affixed to said shaft, said turning means turning both said shaft and said fan assembly.

3. The air propelling apparatus of claim 2 wherein said turning means includes a driven pulley affixed on said shaft, an electric motor in driving engagement with a driver pulley and a belt around said driver and driven pulleys.

4. The air propelling apparatus of claim 3 further comprising a shroud between said intake and exhaust grills, at least one of said grills being detachably attached to said shroud.

5. The air propelling apparatus of claim 4 wherein said electric motor is attached to said shroud.

6. The air propelling apparatus of claim 2 further comprising bearings at each end of said shaft between said shaft and grills.

7. The air propelling apparatus of claim 6 further including bearing retaining plates attached to said grills, each of said bearings mounted on a respective retaining plate.

8. The air propelling apparatus of claim 1 wherein said fan blade assembly is rotatably mounted on said shaft.

9. The air propelling apparatus of claim 2 further comprising a cylindrical shroud having longitudinal ends, said intake grill attached to one longitudinal end and said exhaust grill attached to the other longitudinal end.

10. The air propelling apparatus of claim 8 wherein said turning means includes a driven pulley coaxially around said shaft and affixed to said fan blade assembly, an electric motor in driving engagement with a driver pulley and a belt around said driver and driven pulleys.

11. The air propelling apparatus of claim 10 further comprising a shroud between said intake and exhaust grills, at least one of said grills being detachably attached to said shroud.

12. The air propelling apparatus of claim 11 wherein said electric motor is attached to said shroud.

13. The air propelling apparatus of claim 11 further comprising a cylindrical shroud having longitudinal ends, said intake grill attached to one longitudinal end and said exhaust grill attached to the other longitudinal end.

14. The air propelling apparatus of claim 1 further comprising a cylindrical shroud having longitudinal ends, said intake grill attached to one longitudinal end and said exhaust grill attached to the other longitudinal end.

15. An air propelling apparatus comprising:
an air intake grill;
an air exhaust grill;
a shaft extending between and mounted on said air intake and exhaust grills;
a fan blade assembly on said shaft; and,
means for turning said fan blade assembly whereby air is propelled through said air intake grill and out through said exhaust grill;
wherein said shaft is rotatably mounted on said intake and exhaust grills and said fan assembly is affixed to said shaft, said turning means turning both said shaft and said fan assembly;
a cylindrical shroud having longitudinal ends, said intake grill attached to one longitudinal end and said exhaust grill attached to the other longitudinal end; and,
wherein each of said grills are in planes generally parallel to one another and said shaft is longer than said cylindrical shroud longitudinal length, whereby said grills are caused to flex longitudinally away from said shroud.

16. An air propelling apparatus comprising:
an air intake grill;
an air exhaust grill;
a shaft extending between and mounted on said air intake and exhaust grills;
a fan blade assembly on said shaft; and,
means for turning said fan blade assembly whereby air is propelled through said air intake grill and out through said exhaust grill;
wherein said fan blade assembly is rotatably mounted on said shaft;
a cylindrical shroud having longitudinal ends, said intake grill attached to one longitudinal end and said exhaust grill attached to the other longitudinal end; and,
wherein each of said grills are in planes generally parallel to one another and said shaft is longer than said cylindrical shroud longitudinal length, whereby said grills are caused to flex longitudinally away from said shroud.

17. An air propelling apparatus comprising:
an air intake grill;
an air exhaust grill;
a shaft extending between and mounted on said air intake and exhaust grills;
a fan blade assembly on said shaft; and,
means for turning said fan blade assembly whereby air is propelled through said air intake grill and out through said exhaust grill;
a cylindrical shroud having longitudinal ends, said intake grill attached to one longitudinal end and said exhaust grill attached to the other longitudinal end; and,
wherein each of said grills are in planes generally parallel to one another and said shaft is longer than said cylindrical shroud longitudinal length, whereby said grills are caused to flex longitudinally away from said shroud.

* * * * *